US010607763B2

(12) United States Patent
Matsutani et al.

(10) Patent No.: US 10,607,763 B2
(45) Date of Patent: Mar. 31, 2020

(54) REACTOR

(71) Applicant: Panasonic Intellectual Property Management Co., Ltd., Osaka (JP)

(72) Inventors: Nobuya Matsutani, Osaka (JP); Toshiyuki Asahi, Osaka (JP); Junichi Kotani, Hyogo (JP); Hiroshi Tomita, Hyogo (JP); Hidenori Uematsu, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/570,520

(22) PCT Filed: May 17, 2016

(86) PCT No.: PCT/JP2016/002404
§ 371 (c)(1),
(2) Date: Oct. 30, 2017

(87) PCT Pub. No.: WO2016/185712
PCT Pub. Date: Nov. 24, 2016

(65) Prior Publication Data

US 2018/0174733 A1 Jun. 21, 2018

(30) Foreign Application Priority Data

May 19, 2015 (JP) ..... 2015-101477

(51) Int. Cl.
*H01F 27/22* (2006.01)
*H01F 37/00* (2006.01)
(Continued)

(52) U.S. Cl.
CPC ..... *H01F 27/22* (2013.01); *H01F 27/022* (2013.01); *H01F 27/24* (2013.01); *H01F 37/00* (2013.01); *H01F 27/29* (2013.01)

(58) Field of Classification Search
CPC ..... H01F 27/22; H01F 27/29; H01F 27/24; H01F 27/022
(Continued)

(56) References Cited

U.S. PATENT DOCUMENTS 9,202,623 B2 * 12/2015 Hatch ..... H01F 38/12
2012/0139684 A1 * 6/2012 Kobayashi ..... H01F 27/022 336/92
(Continued)

FOREIGN PATENT DOCUMENTS

JP 2010-166013 7/2010
JP 2012-119545 A 6/2012
(Continued)

OTHER PUBLICATIONS

International Search Report of PCT application No. PCT/JP2016/002404 dated Aug. 2, 2016.

*Primary Examiner* — Tszfung J Chan
(74) *Attorney, Agent, or Firm* — McDermott Will & Emery LLP

(57) ABSTRACT

A reactor includes a coil body, an exterior case, and a filler. The coil body includes a core and a coil wound around the core. The exterior case includes a metal structure and a resin frame. The metal structure has a bottom surface and a side wall provided to stand upright from the bottom surface. The bottom surface and the side wall of the metal structure are unitarily formed with each other. The frame is disposed at an opposite side to the bottom surface of the metal structure. The exterior case houses the core and the coil. The filler is filled between the exterior case and the coil body.

13 Claims, 4 Drawing Sheets

(51) Int. Cl.
*H01F 27/02* (2006.01)
*H01F 27/24* (2006.01)
*H01F 27/29* (2006.01)

(58) Field of Classification Search
USPC ..... 336/90, 92, 94, 96, 98
See application file for complete search history.

(56) References Cited

U.S. PATENT DOCUMENTS

| | | | | |
|---|---|---|---|---|
| 2013/0182478 | A1 | 7/2013 | Nomura et al. | |
| 2014/0085041 | A1* | 3/2014 | Atsumi | H01F 27/402 336/84 M |
| 2014/0197913 | A1* | 7/2014 | Ohoka | H01F 27/362 336/92 |
| 2015/0035636 | A1* | 2/2015 | Nakatsu | H01F 27/263 336/192 |
| 2015/0287525 | A1 | 10/2015 | Yamada et al. | |

FOREIGN PATENT DOCUMENTS

| | | | | | |
|---|---|---|---|---|---|
| JP | 2013-145850 | | | 7/2013 | |
| JP | 2013149943 | A | * | 8/2013 | |
| JP | 2013-229406 | | | 11/2013 | |
| JP | 2013229406 | A | * | 11/2013 | |
| JP | 2014027024 | A | * | 2/2014 | H01F 37/00 |
| JP | 2014-093375 | | | 5/2014 | |
| JP | 2015-032718 | A | | 2/2015 | |
| WO | 2012/039268 | | | 3/2012 | |

* cited by examiner

REACTOR

CROSS-REFERENCE TO RELATED APPLICATIONS

This application is a U.S. national stage application of the PCT International Application No. PCT/JP2016/002404 filed on May 17, 2016, which claims the benefit of foreign priority of Japanese patent application 2015-101477 filed on May 19, 2015, the contents all of which are incorporated herein by reference.

TECHNICAL FIELD

The present disclosure relates to a reactor that is a passive element using an inductance.

BACKGROUND ART

A reactor generally has a configuration in which a coil is wound around a core. A reactor is mainly used in an electric circuit through which a large electric current flows. A loss is generated in the core and the coil of the reactor, and the loss becomes heat energy. As an electric current flowing in the reactor becomes larger, the loss is increased, and accordingly heat generated in the reactor is increased.

There has been known a reactor including a case having a bottom plate portion made of metal and a side wall portion that is independent from the bottom plate portion. The side wall portion of the reactor is formed of resin, or at least a part thereof is formed of metal. The coil of the bottom plate portion has a function as a heat radiation passage of a coil (see PTL 1).

There has also been known a reactor including a case made of, for example, aluminum, having high thermal conductivity. This reactor has a core part in which a core material is housed in a resin member. The core part has a filler outflow prevention portion. The resin member housing a core material and the filler outflow prevention portion are unitarily formed with each other. The filler outflow prevention portion has a function of extending the height of the side surface of the case (see PTL 2).

There has been known a reactor having a configuration in which a bottom plate portion and a side wall portion of a case are formed independently from each other, and the bottom plate portion and the side wall portion are made of insulating resin. In the reactor, the use of insulating resin allows a terminal of the coil to be held by the case (see PTL 3).

There has been known a reactor having a box-shaped case made of metal and having a bottom surface and a side wall. In this reactor, a cut-away portion is provided in a part of the side wall at an end side apart from the bottom surface, and an insulating wall portion is attached to the cut-away portion. An end of the coil is inserted through the insulating wall portion (see PTL 4).

CITATION LIST

Patent Literature

PTL 1: Japanese Patent Application Unexamined Publication No. 2014-093375

PTL 2: Japanese Patent Application Unexamined Publication No. 2013-229406

PTL 3: Japanese Patent Application Unexamined Publication No. 2013-145850

PTL 4: Japanese Patent Application Unexamined Publication No. 2010-166013

SUMMARY OF THE INVENTION

A reactor includes a coil body, an exterior case, and a filler. The coil body includes a core and a coil wound around the core. The exterior case includes a metal structure and a resin frame. The metal structure has a bottom surface and a side wall provided to stand upright from the bottom surface. The bottom surface and the side wall of the metal structure are unitarily formed with each other. The frame is disposed at an opposite side to the bottom surface of the metal structure. The exterior case houses the core and the coil. The filler is filled between the exterior case and the coil body.

DESCRIPTION OF EMBODIMENTS

In recent years, with popularization of hybrid cars and electric cars, a reactor has been used in a driving circuit of a motor of such cars. In order to improve the running property such as acceleration performance, some hybrid cars and electric cars use a motor with a larger electric current. With the increase in electric current in a motor, a reactor has been required to correspond to a larger electric current. Corresponding to a larger electric current of a reactor is also corresponding to heat generation.

A reactor described in PTL 1 has a configuration in which a bottom plate portion and a side wall portion are independent from each other. Consequently, thermal conductivity between the bottom plate portion and the side wall portion is low. Therefore, heat transmitted to the side wall portion is not easily transferred to the bottom plate portion as a heat radiation passage, thus making efficient heat radiation difficult.

In a reactor described in PTL 2, a resin member housing a core material and a filler outflow prevention portion are unitarily formed with each other. In this structure, a part of the core material is not covered with the filler. Consequently, heat from a part of the core material is not efficiently transmitted from the resin member to the case, and heat-radiation property of the reactor is deteriorated.

A reactor described in PTL 3 has a configuration in which a bottom plate portion is independent from a side wall portion in a case. Both the bottom plate portion and the side wall portion are made of insulating resin, thus deteriorating heat radiation.

In a reactor described in PTL 4, the end of a coil is inserted through an insulating wall portion, and therefore, working efficiency of assembly is deteriorated.

EXEMPLARY EMBODIMENT

Figure 1:
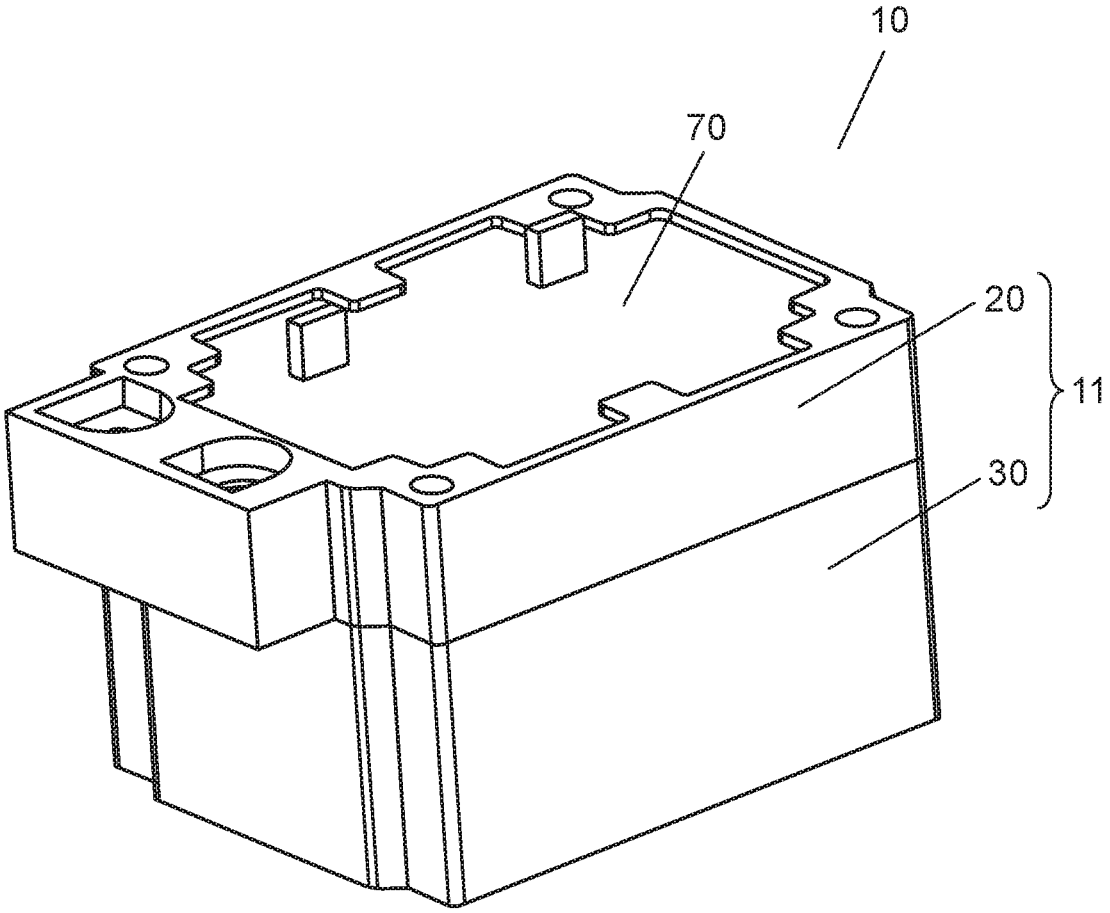
FIG. 1 is an overall perspective view of a reactor in accordance with an exemplary embodiment.
Figure 2:
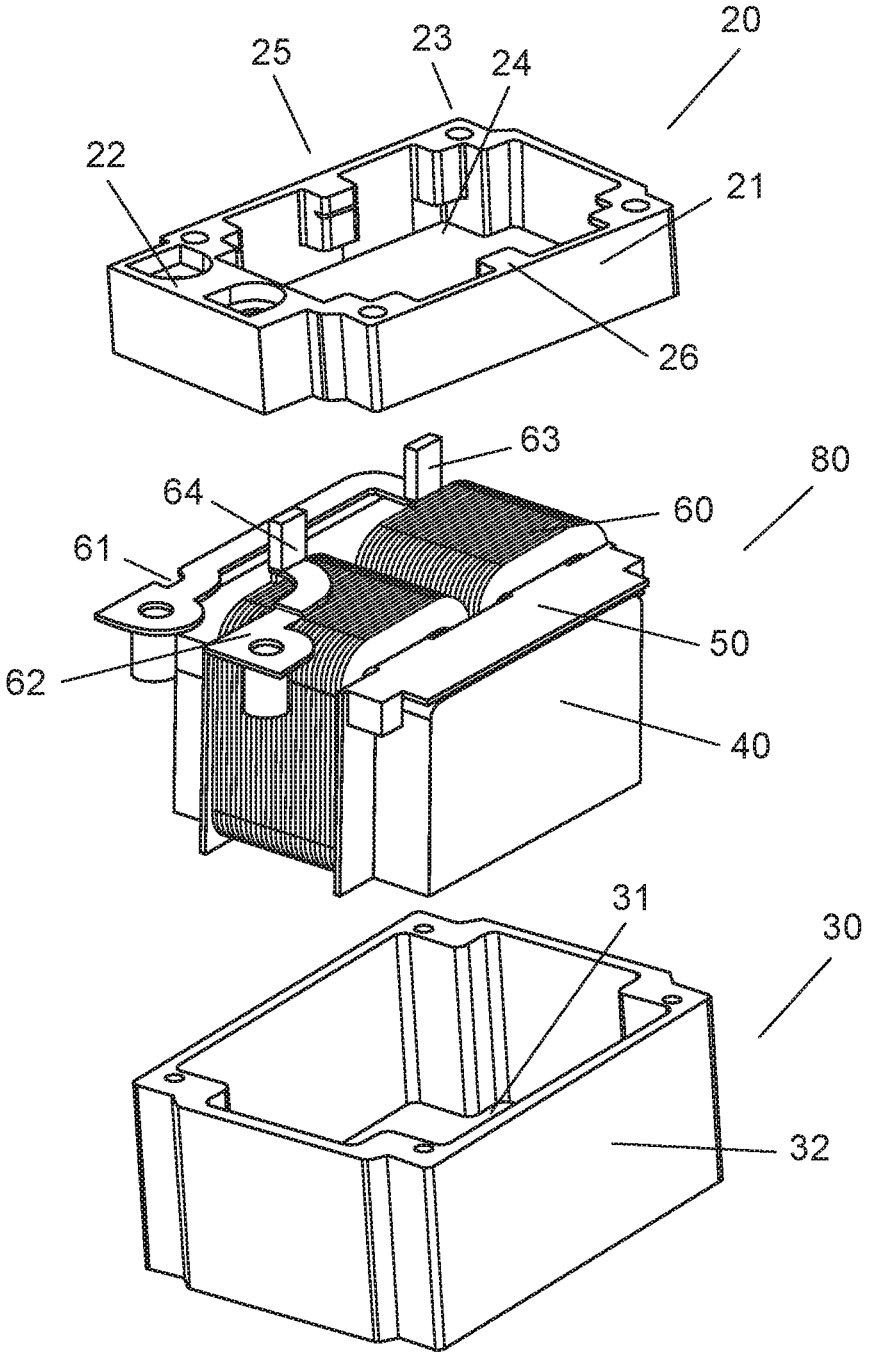
FIG. 2 is an exploded perspective view of the reactor in accordance with the exemplary embodiment.
Figure 3:
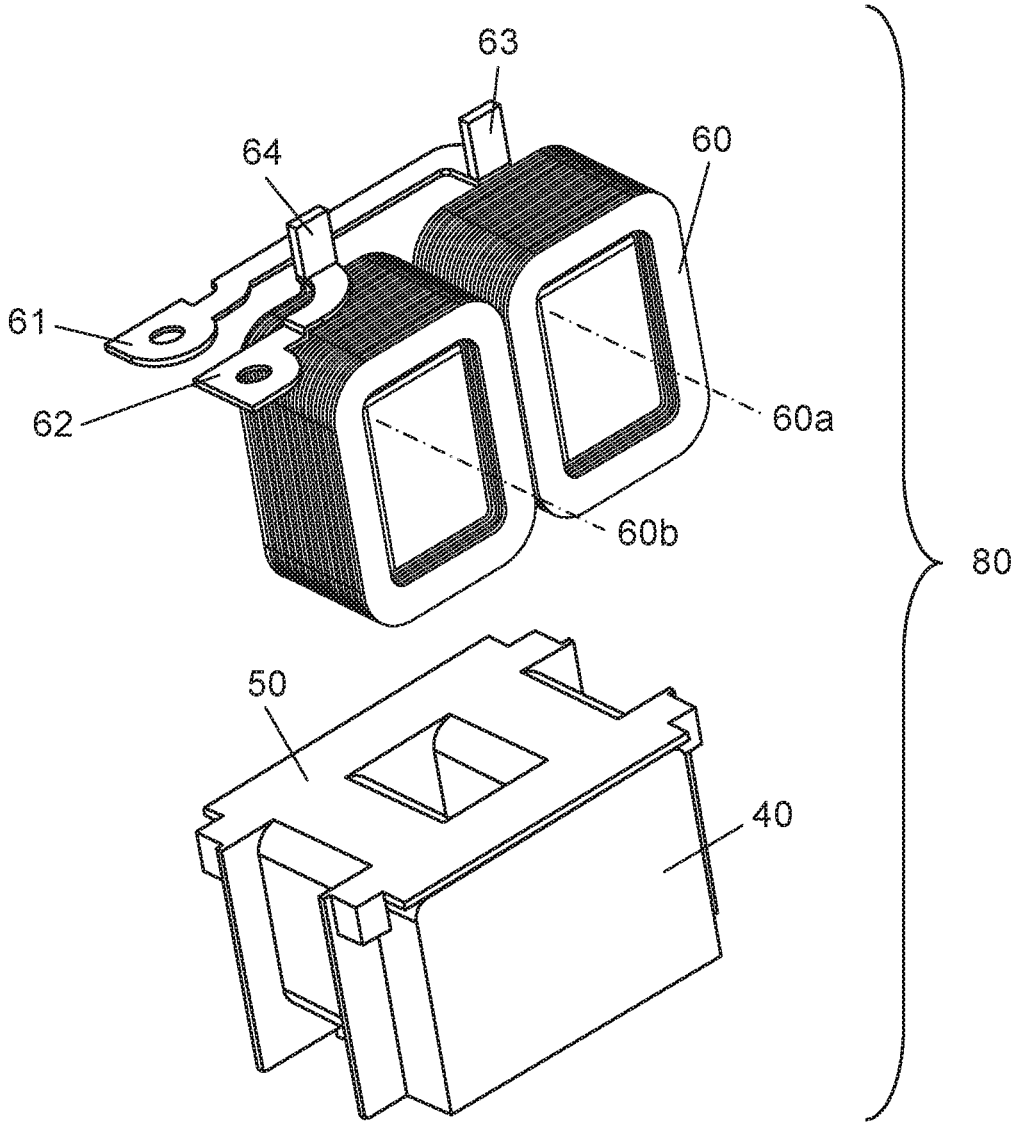
FIG. 3 is an exploded perspective view of a coil body of the reactor in accordance with the exemplary embodiment.
Figure 4:
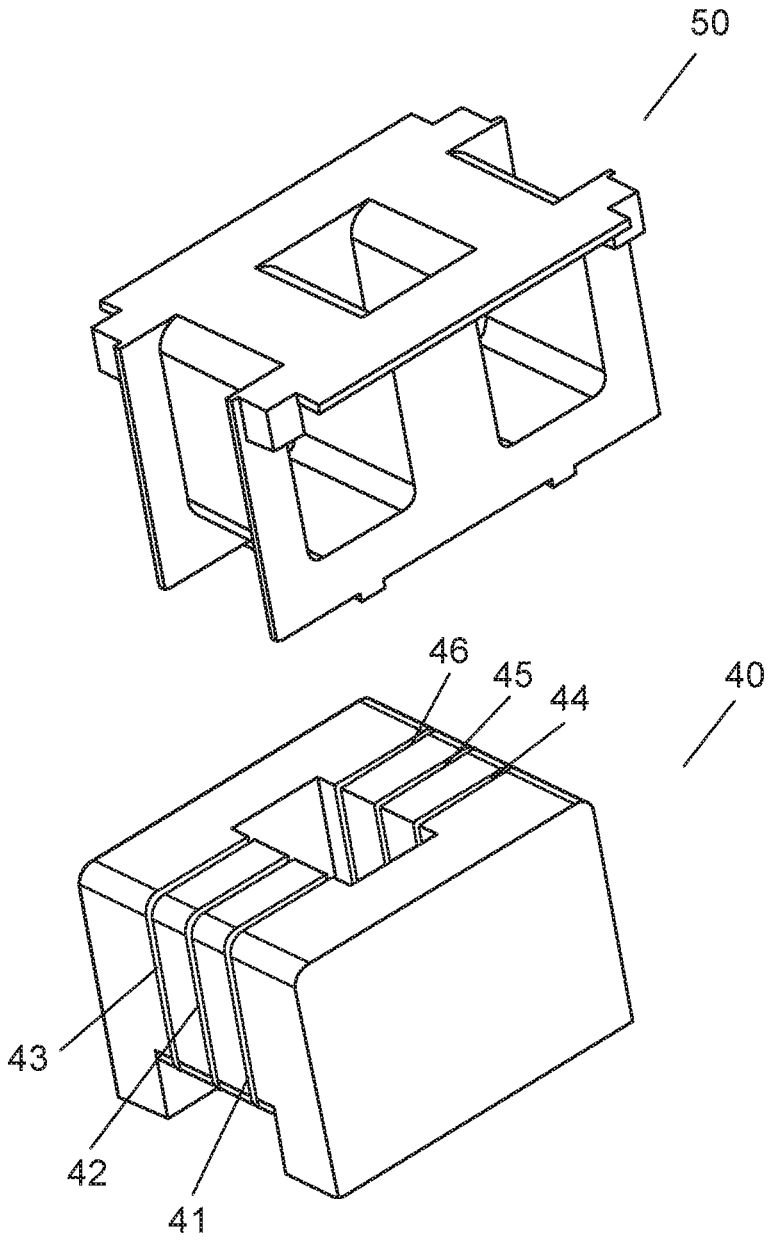
FIG. 4 is an exploded perspective view of a bobbin and a core of the reactor in accordance with the exemplary embodiment.

Reactor 10 of the present disclosure is described hereinafter. FIG. 1 is an overall perspective view of reactor 10 in accordance with an exemplary embodiment. FIG. 2 is an exploded perspective view of reactor 10 in accordance with the exemplary embodiment. FIG. 3 is an exploded perspective view of coil body 80 of reactor 10 in accordance with the exemplary embodiment. FIG. 4 is an exploded perspective view of bobbin 50 and core 40 of reactor 10 in accordance with the exemplary embodiment. Note here that in FIG. 1, coil body 80 is omitted. In FIG. 2, filler 70 is omitted.

Reactor 10 includes coil body 80, exterior case 11, and filler 70. Coil body 80 includes core 40 and coil 60 wound around core 40. Exterior case 11 includes metal structure 30 and resin frame 20. Metal structure 30 has bottom surface 31 and side wall 32 provided to stand upright from bottom surface 31. Bottom surface 31 and side wall 32 of metal structure 30 are unitarily formed with each other. Frame 20 is disposed at an opposite side to bottom surface 31 of metal structure 30. Exterior case 11 houses core 40 and coil 60. Filler 70 is filled between exterior case 11 and coil body 80.

Reactor 10 may include bobbin 50. Hereinafter, a configuration of reactor 10 is described in detail.

Exterior case 11 includes frame 20 and metal structure 30. Frame 20 is formed of resin. Metal structure 30 is formed of metal. It is preferable that metal structure 30 is formed of a substance having high thermal conductivity, for example, aluminum and copper.

Metal structure 30 has bottom surface 31 and side wall 32. Side wall 32 is provided to stand upright from bottom surface 31. In this exemplary embodiment, since bottom surface 31 has a substantially rectangular shape, side wall 32 have four wall surfaces. However, the shape of bottom surface 31 is not necessarily limited to a substantially rectangular shape, and may be shapes other than rectangular shapes including a polygon, a circle, and an ellipse. Bottom surface 31 and side wall 32 are unitarily formed with each other. Herein, a configuration in which bottom surface 31 and side wall 32 are unitarily formed with each other means a configuration in which bottom surface 31 and side wall 32 are not formed independently from each other but formed integrally inseparably. Metal structure 30 is molded by, for example, a die-cast method.

Frame 20 includes side wall 21, terminal portion 22, and upper surface 23. Side wall 21 of frame 20 is positioned on the extension of side wall 32 of metal structure 30. Terminal portion 22 is positioned protruding to the outer side from side wall 32 of metal structure 30. Upper surface 23 is a plane including an upper end of terminal portion 22 of frame 20. Furthermore, frame 20 has open portion 24. Furthermore, upper surface 23 of frame 20 may be provided with stoppers 25 and 26. Stoppers 25 and 26 prevent core 40 and coil 60 from passing through open portion 24.

Filler 70 is filled into exterior case 11. In other words, filler 70 is filled between exterior case 11 and coil body 80. Herein, filler 70 is preferably an insulator. Note here that even when coil 60 itself is covered and insulated, in order to further improve the reliability, filler 70 is preferably an insulator. Filler 70 is filled between core 40 and coil 60, and exterior case 11 without a gap. As an example of filler 70, resin is used. It is preferable that filler 70 allows heat generated from core 40 and coil 60 to be efficiently transmitted to exterior case 11, in particular, to metal structure 30. Therefore, it is preferable to use filler 70 having high thermal conductivity. Examples of such filler 70 include a material obtained by mixing at least one of silicone resin, epoxy resin, acrylic resin, and liquid crystal polymer, with at least one of alumina, aluminum nitride, boron nitride, and carbon, having excellent thermal conductivity. In order to improve magnetic property of reactor 10, filler 70 containing a magnetic substance may be used. As examples of such filler 70, resin containing magnetic powder such as FeAlSi and ferrite can be used. When the magnetic substance itself is not an insulating material, the surface of the insulator is preferably covered with an insulator. In this exemplary embodiment, as filler 70, silicone resin mixed with alumina is used.

Core 40 is a metal composite of a magnetic substance. The metal composite is formed by pressure-molding or pouring a composite of Fe magnetic metal powder, for example, Fe, FeSi, FeAlSi, FeNi, or amorphous magnetic powder, and an insulator into a predetermined shape. In some cases, core 40 is produced by heat treatment at such a high temperature as 600° C. or higher. In order to improve direct-current superimposition characteristics, core 40 of this exemplary embodiment has gaps 41 to 46 as shown in FIG. 4. The number of gaps and the position of gaps are determined depending on the property required by reactor 10. Furthermore, depending on the property required by reactor 10, a gap is not needed. Core 40 has, for example, a hollow square shape seen in a top view.

Bobbin 50 is configured to cover a part of core 40. Specifically, coil 60 is wound around bobbin 50, so that coil 60 covers core 40. That is, coil 60 is not directly wound around core 40, but wound via bobbin 50. In other words, coil 60 is indirectly wound around core 40. Bobbin 50 is an insulator, and is formed of, for example, an ABS resin, or an engineering plastic resin obtained by blending glass into nylon resin. Bobbin 50 enhances insulating property between core 40 and coil 60. As a result, reliability of reactor 10 is enhanced. Bobbin 50 also has a function of holding core 40 and coil 60, and fixing them to exterior case 11.

As shown in FIG. 3, coil 60 has a configuration in which one conductor is wound. Coil 60 has a part wound around central axis 60*a* as a center, and a part wound around central axis 60*b* as a center. Coil 60 preferably has smaller DC resistance. Therefore, as a material of coil 60, for example, copper is suitable. As a conductor constituting coil 60, various shaped conductors are used. In this exemplary embodiment, a flat-type copper wire is used as a conductor of coil 60. Furthermore, coil 60 is formed by so-called edgewise winding. However, the present invention is not limited thereto. A first tip end of coil 60 and terminal 61 are compression-bonded to connection component 63. That is, the first tip end of coil 60 and terminal 61 are physically and electrically connected by connection component 63. In brief, the first tip end of coil 60 is electrically connected to terminal 61. A second tip end of coil 60 and terminal 62 are compression-bonded to connection component 64. That is, the second tip end of coil 60 and terminal 62 are physically and electrically connected by connection component 64. In brief, the second tip end of coil 60 is electrically connected to terminal 62. Furthermore, terminals 61 and 62 are fixed to frame 20. In addition, connection components 63 and 64 are positioned in exterior case 11 seen in a top view. That is, connection portions between coil 60 and terminals 61 and 62 are positioned inside exterior case 11 seen in a top view.

Terminal 61 and terminal 62 are attached to frame 20 by insert molding.

Note here that bobbin 50 may be configured such that it can be divided. For example, coil 60 is wound in a coil shape on bobbin 50 in a state in which bobbin 50 is divided into two, and then two bobbins 50 may be integrated together. Core 40 also may be configured such that it can be divided. For example, core 40 may be mounted on bobbin 50 in a divided state, and then integrated together.

Heat radiation of reactor 10 is carried out by transferring heat to exterior case 11, and radiating heat from exterior case 11. The heat-radiation performance per unit area of bottom surface 31 and side wall 32 of metal structure 30 is changed depending on the shape, arrangement, fixation method, relation to members other than reactor 10, and the like, of bottom surface 31 and side wall 32 of metal structure 30. In a place having excellent heat-radiation property, temperature rise is lower than the other places when the other conditions are the same, and therefore heat is easily received from the other places. Since bottom surface 31 and side wall 32 of metal structure 30 are unitarily formed with each other, heat resistance between bottom surface 31 and side wall 32 is small, and thermal conductivity is excellent. Therefore, heat of bottom surface 31 and side wall 32 of metal structure 30 is easily transmitted to the place having excellent heat-radiation property. As a result, the heat-radiation property of reactor 10 is improved. Reactor 10 of this exemplary embodiment is excellent in heat transfer in metal structure 30, and therefore, is very useful for carrying out heat radiation of reactor 10 by, for example, bringing a part of metal structure 30 (for example, bottom surface 31) into contact with a cooling pipe.

In this exemplary embodiment, since side wall 32 of metal structure 30 has a sufficient depth, central axis 60*a* and central axis 60*b* of coil 60 cross side wall 32 of metal structure 30. That is, metal structure 30 houses at least a part of coil body 80. Thus, it is possible to transmit a large amount of heat generated from core 40 and heat generated from coil 60 to side wall 32 of metal structure 30 and bottom surface 31. As a result, heat-radiation property of reactor 10 is improved. It is preferable that entire core 40 is configured to fall within a space surrounded by side wall 32 and bottom surface 31 of metal structure 30, because further larger amount of heat generated from core 40 can be dissipated to side wall 32 and bottom surface 31 of metal structure 30. That is, core 40 is preferably surrounded by side wall 32 of metal structure 30. It is more preferable that when core 40 and coil 60 are configured to fall within a space surrounded by side wall 32 and bottom surface 31 of metal structure 30, because heat-radiation property can be further improved. That is, it is preferable that coil body 80 is surrounded by side wall 32 of metal structure 30.

As mentioned above, reactor 10 of the present disclosure includes core 40, coil 60 wound on core 40, and exterior case 11 that houses at least a part of core 40 and coil 60. Furthermore, filler 70 may be filled between exterior case 11 and coil body 80. Exterior case 11 includes frame 20 made of resin and metal structure 30 made of metal. Metal structure 30 has bottom surface 31, and side wall 32 provided to stand upright from side wall 31. Bottom surface 31 and side wall 32 of metal structure 30 are unitarily formed with each other. This configuration improves heat-radiation property. Furthermore, since frame 20 is formed of resin, a creepage distance or the like for withstand voltage is not required to be more than necessary. Thus, the degree of freedom in design is high.

The central axis of coil 60 of reactor 10 of the present disclosure crosses side wall 32 of metal structure 30. This configuration enables a large part of heat generated in coil 60 and core 40 to be radiated from metal structure 30.

Reactor 10 of the present disclosure further includes terminals 61 and 62 connected to coil 60. Terminals 61 and 62 are fixed to frame 20. In reactor 10, since frame 20 has a function of fixing terminals 61 and 62, increase in the number of components can be reduced, thus enabling production cost to be reduced.

In reactor 10 of the present disclosure, the connection portions between coil 60 and terminals 61 and 62 are positioned inside exterior case 11 seen in a top view. Since the connection portions are positioned inside exterior case 11 seen in a top view, an area of entire reactor 10 becomes smaller. Furthermore, since frame 20 is formed of resin, a creepage distance or the like for withstand voltage is not required to be more than necessary. Thus, reactor 10 can be made small in size.

In reactor 10 of the present disclosure, frame 20 has open portion 24, and the upper surface of frame 20 is provided with stoppers 25 and 26 for preventing core 40 and coil 60 from passing through open portion 24. This configuration makes it possible to reliably house core 40 and coil 60 in exterior case 11.

Reactor 10 of the present disclosure improves the heat-radiation property.

INDUSTRIAL APPLICABILITY

A reactor of the present disclosure is useful as a passive element using an inductance.

REFERENCE MARKS IN THE DRAWINGS

10 reactor
11 exterior case
20 frame
21 side wall
22 terminal portion
23 upper surface
24 open portion
25 stopper
26 stopper
30 metal structure
31 bottom surface
32 side wall
40 core
41 gap
42 gap
43 gap
44 gap
45 gap
46 gap
50 bobbin
60 coil
60*a* central axis
60*b* central axis
61 terminal
62 terminal
63 connection component
64 connection component
70 filler
80 coil body

The invention claimed is:

1. A reactor comprising:

a coil body including:

a core, and a coil wound around the core;

an exterior case including:

a metal structure having a bottom surface and a side wall provided to stand upright from the bottom surface, and a resin frame disposed at an opposite side to the bottom surface of the metal structure, the resin frame including a side wall; and a filler filled between the exterior case and the coil body, wherein the bottom surface and the side wall of the metal structure are unitarily formed with each other, and the exterior case houses the core and the coil, the side wall of the resin frame is disposed on the side wall of the metal structure so as to form an extension of the side wall of the metal structure, an outer surface of the side wall of the resin frame and an outer surface of the side wall of the metal structure being aligned with one another when viewed in plan, and the filler fills from the metal structure to at least a part of the side wall of the resin frame.

2. The reactor of claim 1, wherein the bottom surface and the side wall of the metal structure are molded by a die-cast method.

3. The reactor of claim 1, wherein a central axis of the coil crosses the side wall of the metal structure.

4. The reactor of claim 1, wherein the metal structure houses at least a part of the coil body.

5. The reactor of claim 1, wherein the core is surrounded by the side wall of the metal structure.

6. The reactor of claim 1, wherein the coil body is surrounded by the side wall of the metal structure.

7. The reactor of claim 1, further comprising a terminal connected to the coil, wherein the terminal is fixed to the frame.

8. The reactor of claim 7, wherein a connection portion between the coil and the terminal is positioned inside the exterior case seen in a top view.

9. The reactor of claim 1, wherein the frame includes an open portion, and a stopper for preventing the core and the coil from passing through the open portion.

10. The reactor of claim 1, wherein the filler is silicone resin mixed with alumina.

11. The reactor of claim 1, wherein the side wall of the metal structure extends from the bottom surface of the metal structure to a top surface of the metal structure, and wherein the side wall of the resin frame has a bottom surface connected to the top surface of the metal structure, and the side wall of the resin frame extends upwardly from the side wall of the metal structure in the same direction as the side wall of the metal structure.

12. The reactor of claim 11, wherein the bottom surface of the side wall of the resin frame faces the top surface of the metal structure, and directly contacts the top surface of the metal structure.

13. The reactor of claim 11, wherein the bottom surface of the side wall of the resin frame is disposed on the entire top surface of the metal structure.

* * * * *